US009265318B1

(12) United States Patent
Williams et al.

(10) Patent No.: US 9,265,318 B1
(45) Date of Patent: Feb. 23, 2016

(54) INSULATED BAG

(71) Applicants: Benjamin Williams, Norwood, MA (US); Brian E Grady, Worcester, MA (US); Benjamin J Campbell, Milford, MA (US); William M Feather, Upton, MA (US); Laurra C Winters, Natick, MA (US); Edward Recke, Natick, MA (US)

(72) Inventors: Benjamin Williams, Norwood, MA (US); Brian E Grady, Worcester, MA (US); Benjamin J Campbell, Milford, MA (US); William M Feather, Upton, MA (US); Laurra C Winters, Natick, MA (US); Edward Recke, Natick, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 2 days.

(21) Appl. No.: 14/254,264

(22) Filed: Apr. 16, 2014

Related U.S. Application Data

(63) Continuation of application No. 13/304,832, filed on Nov. 28, 2011, now abandoned, and a continuation-in-part of application No. 14/042,760, filed on Oct. 1, 2013, now abandoned.

(51) Int. Cl.
*A45C 11/20* (2006.01)
*B65D 81/38* (2006.01)

(52) U.S. Cl.
CPC ..... *A45C 11/20* (2013.01); *B65D 81/3886* (2013.01)

(58) Field of Classification Search
CPC ..... B65D 81/3876; B65D 81/3886; B65D 81/3888; B65D 81/3893; B65D 81/3895; B65D 81/389; B65D 81/3897; F25D 3/08; A45C 11/20
USPC ..... 224/148.3; 220/592.2, 592.24, 592.25, 220/592.26, 915.2; 383/110; 62/457.1, 62/457.7, 530
See application file for complete search history.

(56) References Cited

U.S. PATENT DOCUMENTS

| | | | | | |
|---|---|---|---|---|---|
| 3,443,397 | A * | 5/1969 | Donovan et al. | 62/398 |
| 5,031,554 | A * | 7/1991 | Glenn | 112/475.18 |
| 5,505,307 | A * | 4/1996 | Shink | 206/541 |
| 5,904,230 | A * | 5/1999 | Peterson | 190/107 |
| D446,937 | S * | 8/2001 | Mogil | D3/301 |
| 2003/0024960 | A1 * | 2/2003 | Greenstein et al. | 224/153 |
| 2003/0136702 | A1 * | 7/2003 | Redzisz et al. | 206/545 |
| 2010/0155437 | A1 * | 6/2010 | Broadbent et al. | 224/148.1 |

* cited by examiner

*Primary Examiner* — Justin Larson
*Assistant Examiner* — Scott McNurlen
(74) *Attorney, Agent, or Firm* — Roger C. Phillips

(57) ABSTRACT

Insulated bags having at least three unitary layers of durable material are provided. In one embodiment, a first set of unitary layers of durable material forms a front wall, a bottom wall, and a rear wall. Two additional sets of unitary layers of durable material form side-walls. Edges of the two additional sets are joined to side and bottom edges of the first set by adding webbing and stitching together the joined edges and webbing. Disposed within the two inner most layers of the first set and the two additional sets is at least one layer of insulation. The first set and the second set are sealed at their top edge to secure the insulation. Horizontal webbing is attached to the bag via stitching through the horizontal webbing, each of the layers of the first set and the second set, and the at least one layer of insulation. Vertical straps are integrated into the bag between the horizontal webbing and the outer most layer of durable material of the first set. On the top of the bag is a mini-flap. Hook/loop fasteners are strategically positioned on the bag to secure access points on the bag. Optional features can be incorporated into the bag (e.g., side handles, a top handle, a durable bottom, a grommet, and a liner). Other embodiments of insulated bags are described herein (e.g., a bag that has the outer layer of the first set and the second set sandwiched between two layers of horizontal webbing).

6 Claims, 10 Drawing Sheets

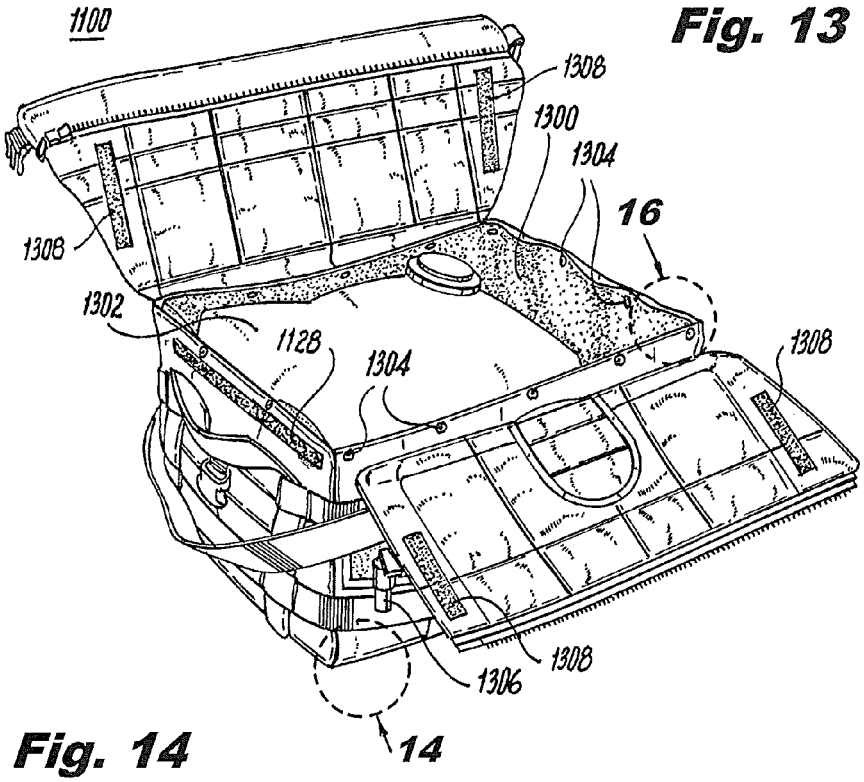
Fig. 13
Fig. 14
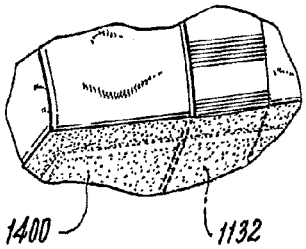
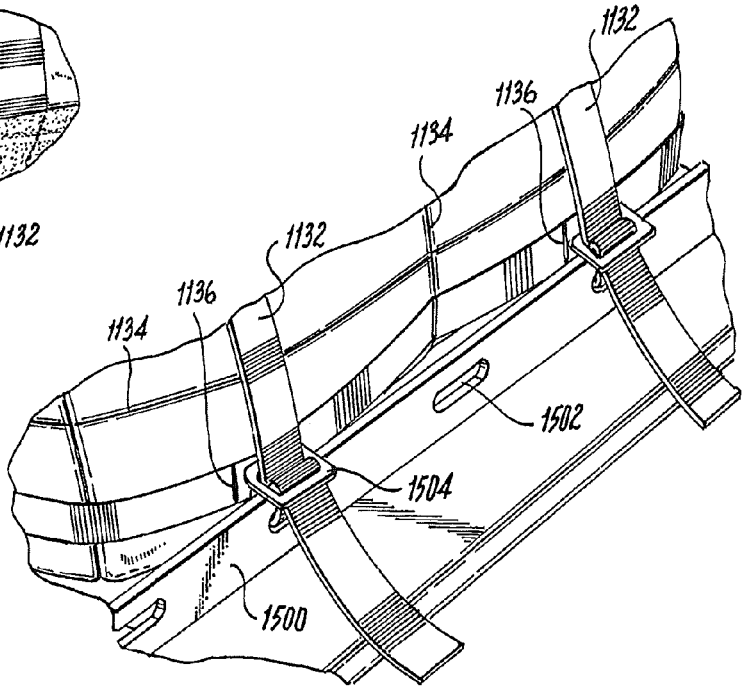
Fig. 15

Fig. 18
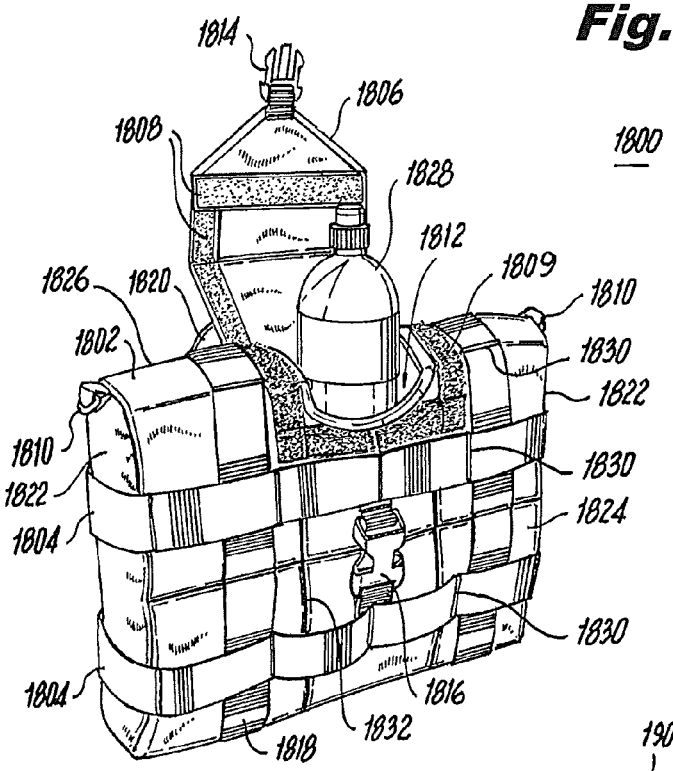
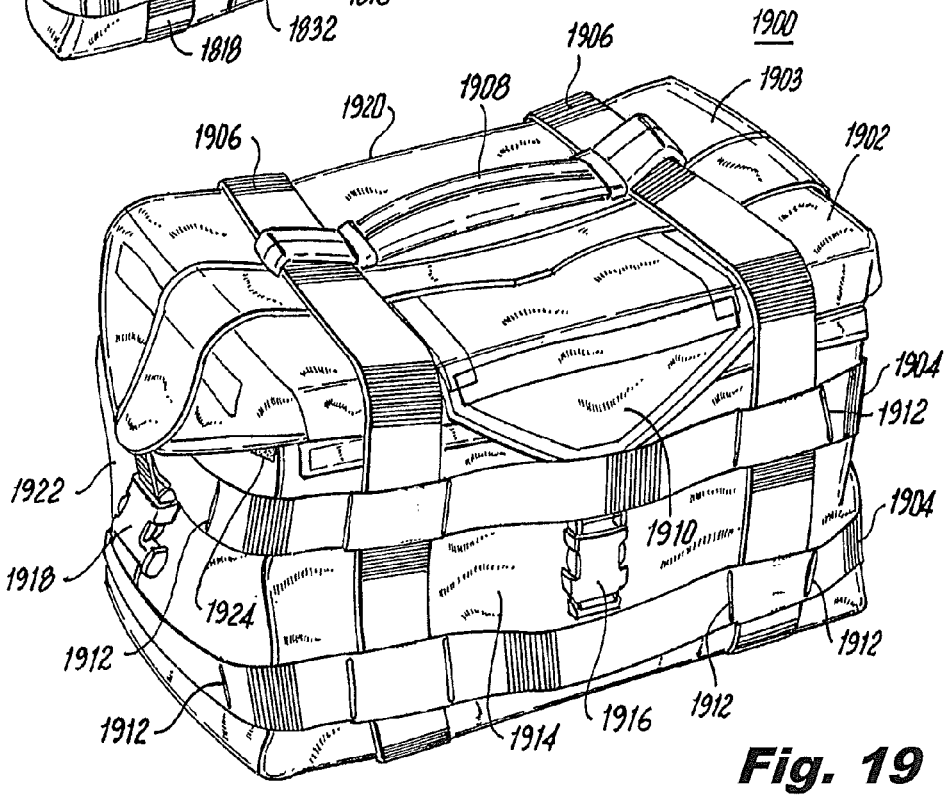
Fig. 19

INSULATED BAG

CROSS-REFERENCE TO RELATED APPLICATION

This application is a continuation-in-part of U.S. patent application Ser. No. 14/042,760 filed Oct. 1, 2013 which, in turn, is a continuation of U.S. patent application Ser. No. 13/304,832 filed Nov. 28, 2011.

STATEMENT OF GOVERNMENT INTEREST

The invention described herein may be manufactured and used by or for the U.S. Government for governmental purposes without the payment of any royalties thereon or therefor.

BACKGROUND

1. Field of the Invention

Embodiments herein generally relate to apparatuses for portable insulated fluid bags. In particular, the present invention relates to novel apparatuses for portable insulated bags for a jerry can.

2. Description of the Related Art

War-fighters, for extended periods of time (e.g., from 6 hours to 48 hours), are in extreme temperatures. During these extended periods war-fighters often need to carry water. The water can be unpalatable due to extremely low and extremely high ambient temperatures. For example, water can become warm due to extremely high ambient temperatures, solar radiation, and/or from vehicles that are used to transport the water. Neither warm nor hot water is palatable; thereby reducing the voluntary intake of water.

A lack of water intake can initiate heat induced ailments such as heat syncope, heat exhaustion, heat stroke, and dehydration. These factors can reduce the combat effectiveness of the war-fighter, which can be detrimental to mission requirements. Drinking cold water ~70° F. can drastically thwart heat related ailments, as well as improve cognitive function and endurance. When compared to drinking warm water, water at palatable temperatures can increase exercise endurance capacity by 23±16% as well as reduce heart rate and psychological strain.

Implementing an advanced insulated bag in conjunction with a system which would allow war-fighters to cool their drinking water via any military vehicle in a reasonable time and then keep it cooler for longer periods would improve the war-fighter's physical stamina, health, and morale. It would also save money by reducing the quantity of bottled water used by allowing the war-fighters to more effectively utilize and cool on-site purified drinking water at any time during a mission. Keeping the water cool for longer periods via an insulated bag would also reduce of frequency of having to cool the water. In addition, the war-fighters would discard less water because more water would be consumed before it reaches an unpalatable temperature.

War-fighters often carry water in a five gallon jerry can. Providing insulation for the jerry can would help keep the water contained therein at palatable temperatures. Prior art insulative bags for the jerry cans contain a single strap to carry the jerry can on the war-fighter's side. Carrying the jerry can using the single strap causes the war-fighter to carry the jerry can off the war-fighter's center of gravity, is uncomfortable, and causes undue back strain/pain. For durability, the prior art insulative bags utilize a wooden bottom which adds significant weight to the insulative bag and the war-fighter's carry load. The prior art insulative bags use a fiberglass based insulation which can absorb moisture. After the fiberglass based insulation has absorbed moisture, the moisture become stagnant and allows bacteria to grow.

There are prior art bags that act as part of a hydration system. These systems have very specific designs to strap the system to a user's back. Some of these systems adjust a water level as water is removed from the hydration system. However, none of these systems are designed and constructed in a manner described in greater detail below.

Some prior art systems merely include an outer insulative material sandwiched between an outer layer and inner layer. However, these systems are not designed and constructed as described below.

Available prior hydration systems (also known as "coolers") are hard/rigid and occupy space when not in use. In addition, it is extremely difficult to keep these hydration systems safely restrained to an object when the object sustains an impact. As a result of the impact, these coolers (and the contents therein (e.g., water bottles)) can become dangerous projectiles.

Thus there is a need in the art for insulative bag that increases the time that water remains at palatable temperatures, reduces weight, is easier to carry, reduces the likelihood of bacterial growth, is less expensive than the prior art insulative systems, has greater structural integrity than prior art systems, and is designed to remain secured to a structure when the structure is impacted.

SUMMARY

Embodiments herein generally relate to apparatuses for portable insulated fluid bags. In particular, the present invention relates to novel apparatuses for portable insulated bags for a jerry can.

In one embodiment, an insulated bag includes a body having a substantially rectangular footprint and four distinct exterior sides. A flap connects the body to a lid. The lid includes for distinct exterior sides. An interior of the body allows a jerry can bag to fit snugly therein. The exterior of the bag has handles on two of its sides to allow multiple users to simultaneously carry the bag. The exterior of the bag also includes two padded shoulder straps to allow a user to carry the bag across the user's upper back and in line with the user's center of gravity. The bag includes a lay of hydrophobic insulation sandwiched between two layers of durable material. A bottom of the bag includes an additional lay of a different durable material.

In another embodiment, an insulated bag has at least three unitary layers of durable material. A first set of unitary layers of durable material forms a front wall, a bottom wall, and a rear wall. Two additional sets of unitary layers of durable material form side-walls. An outer most layer of the first set and an outer most layer of the two additional sets are sandwiched between two layers of horizontal webbing. Side edges of the two additional sets are joined to side and bottom edges of the first set by adding webbing and stitching together the joined edges and webbing. Disposed within the two inner most layers of the first set and the two additional sets is at least one layer of insulation. The first set and the two additional sets are sealed at their top edges to secure the insulation. Vertical straps are integrated into the bag between the horizontal webbing and the outer most layer of durable material of the first set. On the top of the bag is a mini-flap. Hook/loop fasteners are strategically positioned on the bag to secure access points on the bag. In this embodiment, no stitching goes through the insulation.

In yet another embodiment, an insulated bag has at least three unitary layers of durable material. A first set of unitary layers of durable material forms a front wall, a bottom wall, and a rear wall. Two additional sets of unitary layers of durable material form side-walls. Edges of the two additional sets are joined to side and bottom edges of the first set by adding webbing and stitching together the joined edges and webbing. Disposed within the two inner most layers of the first set and the two inner most layers of the two additional sets is at least one layer of insulation. The first set and the two additional sets are sealed at their top edges to secure the insulation. Horizontal webbing is attached to the bag via stitching through the horizontal webbing, each of the layers of the first set and the two additional sets, and the at least one layer of insulation. Vertical straps are integrated into the bag between the horizontal webbing and the outer most layer of durable material of the first set. On the top of the bag is a mini-flap. Hook/loop fasteners are strategically positioned on the bag to secure access points on the bag. Other embodiments of insulated bags are described herein.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 13 depicts yet another perspective view of the embodiment depicted in FIG. 11;

FIG. 14 depicts a bottom corner portion of the embodiment depicted in FIG. 14;

FIG. 15 depicts still another perspective view of the embodiment depicted in FIG. 11;

FIG. 18 depicts another embodiment of the invention;

FIG. 19 depicts yet another embodiment of the invention; and

To facilitate understanding, identical reference numerals have been used, wherever possible, to designate identical elements that are common to the figures.

DETAILED DESCRIPTION

In the following description, numerous specific details are set fourth to provide a more thorough understanding of the invention. As will be apparent to those skilled in the art, however, various changes using different configurations may be made without departing from the scope of the invention. In other instances, well-known features have not been described in order to avoid obscuring the invention. Thus, the invention is not considered limited to the particular illustrative embodiments shown in the specification and all such alternate embodiments are intended to be included in the scope of the appended claims.

Figure 1:
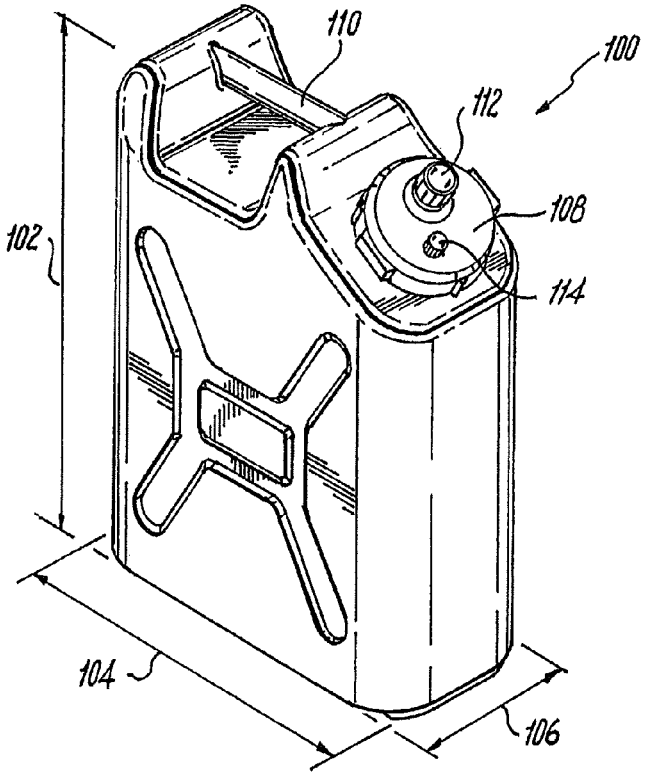
Fig. 1 (Prior Art)
FIG. 1 depicts a perspective view of a 5 gallon can in accordance with the prior art.

FIG. 1 depicts a perspective view of a 5 gallon can 100. The 5 gallon can 100 is hereinafter referred to as "Jerry can 100." Jerry can 100 has dimensions which include a height 102, a length 104, and a width 106. Typically, the height 102 is about 18.25 inches, the length 104 is about 13.75 inches, and the width 106 is about 6.5 inches. The jerry can 100 typically has a wall thickness of about ¼ in, a single threaded cap 108, and an integrated carry handle 110. The cap 108 includes an air release valve 114 and fluid valve 112. The air release valve 114 can be adjusted to help regulate the amount of air entering the jerry can 100 and the flow of water which flows out of the jerry can 100 when fluid valve 112 is opened. Jerry can 100 can be made of various materials (e.g., metal or plastic).

Figure 2:
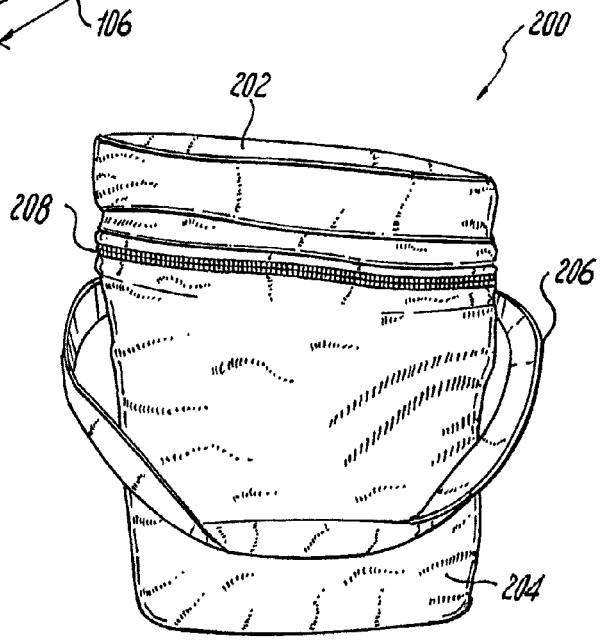
Fig. 2 (Prior Art)
FIG. 2 depicts a perspective view of a prior art insulated bag.

FIG. 2 depicts a perspective view of a prior art insulated jerry bag 200. The prior art insulated bag 200 has an oval footprint and includes a bag lid 202 and a bag body 204. A zipper 208 is used to seal/unseal the bag lid 202 from the bag body 204.

The insulated bag 200 includes a single sling strap 206 for carrying the insulated bag 200 over a shoulder and along one's side. The single sling strap 206 is a nylon shoulder strap sewn to the bag 200 on one side and attached to the bag 200 on the other via a stainless steel clip (not shown).

For durability and rigidity, the insulated bag 200 includes a wooden bottom (not shown). The wooden bottom adds weight to the insulated bag 200. The insulated bag 200 includes a fiberglass based insulation (not shown), usually about 1 inches thick, sandwiched between two layers of heavy duty vinylized canvas. Although treated for mildew resistance, the vinylized canvas (and other materials typically used), often, allows moisture to seep through and into the insulation. Because the insulation absorbs and holds the moisture, bacteria can grow in the damp insulation and wooden bottom. In addition, trapped moisture can become stagnant and emanate an unpleasant odor. The weight of the insulated bag 200 is about 8.75 lb. The insulated bag 200 costs $115.00 (United States currency).

Embodiments of the invention are designed to allow items (e.g., a 5-gal jerry, a bladder filled with fluid, and/or water bottles) to reside therein and to extend the duration that the fluid (e.g., water) will remain at a palatable temperature in ambient temperatures (e.g., up to about 120° F., such as the temperatures in Iraq or in extremely cold temperatures). For example, the duration of time, that fluids are to be kept warm, is extended when the jerry can 100 is placed inside of insulated bag 300 (described below). Various embodiments of construction of an insulated bag in accordance with aspects disclosed herein are depicted in FIGS. 11-20 and described in greater detail below.

In addition, other bag systems can be used in conjunction with the material disclosed herein. For example, this application incorporates by reference all of the material disclosed with commonly assigned U.S. patent application Ser. No. 13/718,249 filed 18 Dec. 2012 and entitled "BEVERAGE COOLING UNIT."

Figure 3:
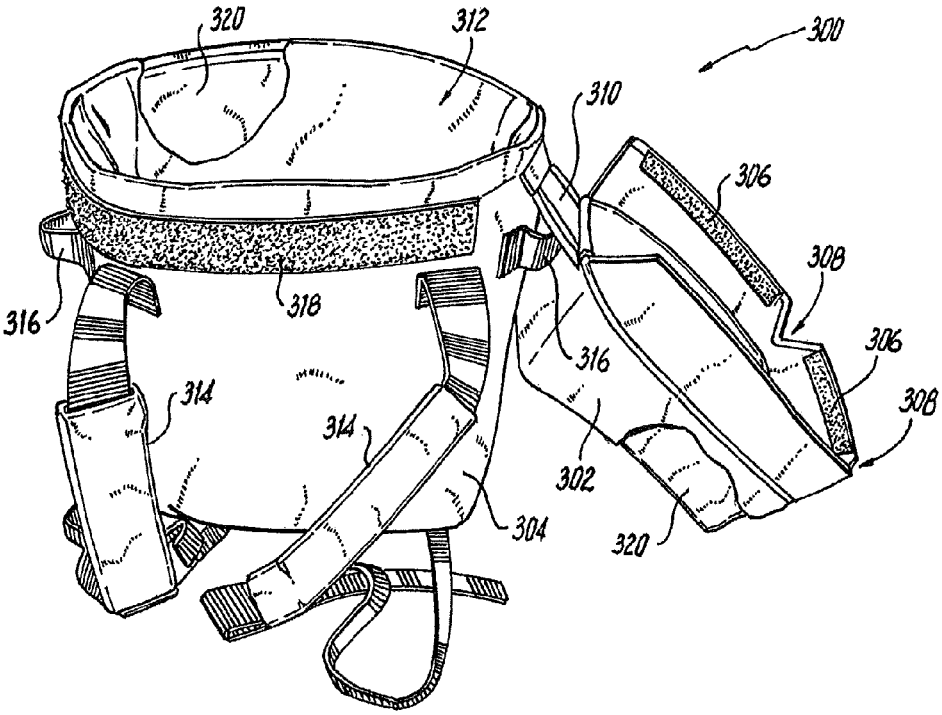
FIG. 3 depicts a perspective view of an insulated bag in accordance with embodiments of the invention.

FIG. 3 depicts a perspective view of an insulated bag 300, in an open position, in accordance with embodiments of the invention. Specifically, insulated bag 300 includes a lid 302 and a bag body 304.

The lid 302 includes either strips of hook members (or loop members) 306 (also known as VELCRO) around the inner periphery of the lid 302 to secure the lid 302 to the bag body 304. The lid 302 also includes multiple "V" shaped flap cutaways 308. The flap cutaways 308 allow a user to insert a hand (even when wearing a mitten) under a flap cutaway 308 and lift up on the lid 302 to open the insulated bag 300. When the insulated bag 300 is open, the lid 302 is held to the insulated bag 300 by a flap 310.

Although the flap cutaways 308 are described herein as having a "V shape" those are not intended in any way to limit the scope of the invention. In various embodiments, flap cutaways 308 have any shape that allows a user leverage to open the insulated bag 300.

The bag body 304 includes an interior 312 sufficient in size for the jerry can 100 to reside therein. The bag body 304 includes side handles 316 positioned on either side of the bag body 304 to allow multiple individuals to simultaneously carry the insulated bag 300. The bag body 304 also includes multiple shoulder straps 314 to allow a user to simultaneously carry the insulated bag 300 over both shoulders simultaneously for better distribution of the weight of the insulated bag 300, less fatigue on the user's back, and less fatigue on a single shoulder if the insulated bag 300 were only carried by a single strap. Also on the outer periphery of the bag body 304, are loop members 318 (or hook members) which mate with the hook members (or loop members) 306 to secure the insulated bag 300.

In various embodiments, the insulated bag 300 includes padding (not shown) on a portion of the insulated bag 300 that is in contact with a user's back. Padding provides additional comfort to a user carrying the insulated bag 300.

In various embodiments, the insulated bag 300 includes a hip strap (not shown) to further secure the insulated bag 300 to the user. The hip strap is secured to a lower portion of insulated bag 300 and can be worn the around the user's waist.

The insulated bag 300 can be made of various hydrophobic and durable materials. For example, in various embodiments, the insulated bag 300 utilizes SPACELOFT insulation (a registered trademark of Aspen Aerogels headquartered in Northborough, Mass.) sandwiched between two layers of CORDURA fabric (a registered trademark of Invista headquartered in Wichita, Kans.).

In contrast to the insulation used in the prior art jerry bag 200, the insulated bag 300 utilizes a hydrophobic insulation that is substantially thinner than the moisture absorbing fiberglass based material utilized in jerry bag 200. Although the SPACELOFT 8 insulation, utilized in various embodiments of the invention, has an "R-value" of about 10.3/inch and a thickness of about 0.2 to about 0.4 inches, other embodiments of the invention utilize insulation having a higher R-value than the SPACELOFT® insulation and a different thickness.

Although CORDURA® fabric has been provided as an example that is not intended in any way to limit the scope of the invention. For example, various embodiments of the invention utilize materials having a linear density greater than (or less than) 500 denier and more durable than CORDURA® fabric.

In various embodiments, the weight of the insulated bag 300 is about 4.65 lbs. to about 4.8 lbs and the thickness of the hydrophobic insulation is about 0.2 inches to about 0.4 inches. However, in other embodiments of the invention, the thickness of the hydrophobic insulation is different than the ranges indicated above. In addition, the weight of the insulated bag 300 can also be different than the weight range indicated above. The cost of the insulated bag 300 is of the same as the prior art insulated bag 200.

Figure 4:
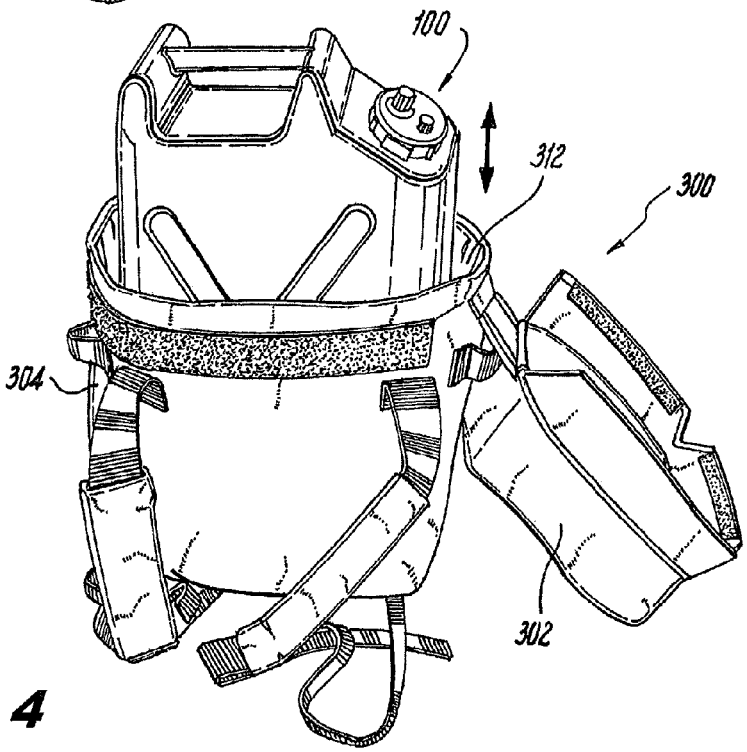
FIG. 4 depicts a perspective view of the insulated bag, having the 5 gallon can therein, in accordance with embodiments of the invention.

FIG. 4 depicts a perspective view of the insulated bag 300, having the 5 gallon jerry can 100 therein, in accordance with embodiments of the invention. Specifically, FIG. 4 depicts the insulated bag 300 in an open position and having the jerry can 100 in the bag interior 312 (i.e., inside of the insulated bag 300). In various embodiments, the jerry can 100 fits snugly inside the insulated bag 300.

Figure 5:
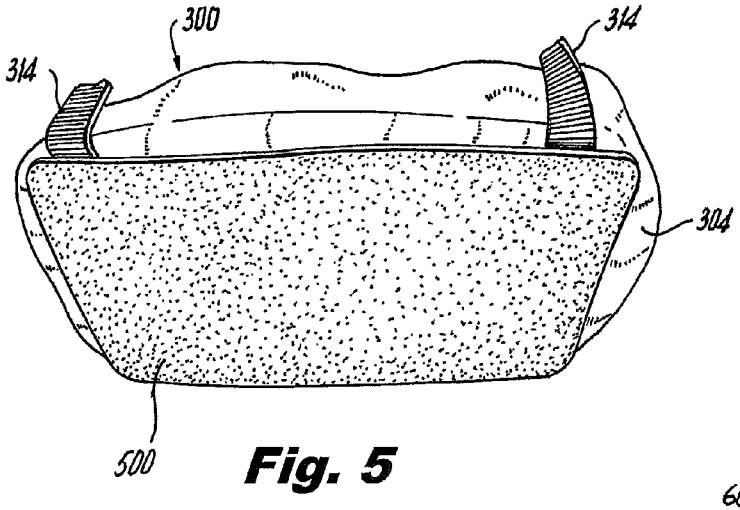
FIG. 5 depicts another perspective view of a bottom of the insulated bag in accordance with embodiments of the invention.

FIG. 5 depicts another perspective view of a bottom 500 of the insulated bag 300 in accordance with embodiments of the invention. The bottom 500 is can be made of any light weight durable material (e.g., rubber). In various embodiments, the light weight material (e.g., rubber) includes ribbing to add durability and traction. In yet other embodiments, the bottom 500 includes materials (e.g., rubber) with varying hardness and tread patterns.

Figure 6A:
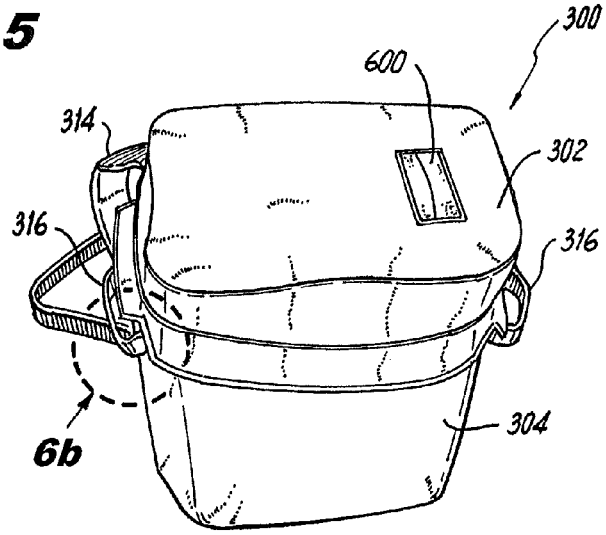
FIG. 6*a* is another perspective view of the insulated bag in accordance with embodiments of the invention.

FIG. **6*a* is another perspective view of the insulated bag 300 in accordance with embodiments of the invention. FIG. 6*a* depicts the insulated bag 300 in a closed position (i.e., although not depicted in FIG. 6*a*, the hook member 306 and loop member 318 are in contact with each other). FIG. 6*a* also depicts an integrated pass-through grommet 600 on lid 302. The pass-through grommet 600 allows a quick connection/disconnection of hoses from a cooling system or other unit with similar connections. When the insulated bag 300 is in the closed position, the V-shaped flap cut-away 308 allows easier separation of the hook member 306 and loop member 318 to open the insulated bag 300**.

Figure 6B:
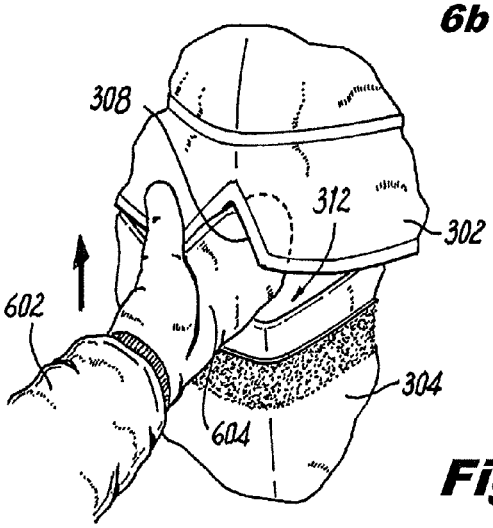
FIG. 6*b* is yet another perspective view of the insulated bag in accordance with embodiments of the invention.

FIG. **6*b* is yet another perspective view of the insulated bag 300, in accordance with embodiments of the invention. FIG. 6*b* operation of the V-shaped flap cut-away to open the insulated bag 300. The flap cut-away 308 allows insertion of a naked hand (or gloved hand) under the flap-cut-away 308 to open the insulation bag 300. For example, a user 602 wearing a mitten 604 is able to insert the mitten 604 under flap cut-away 308 to disengage the connection of the hook member 306 from the loop member 318 and open the insulated bag 300**.

Figure 7:
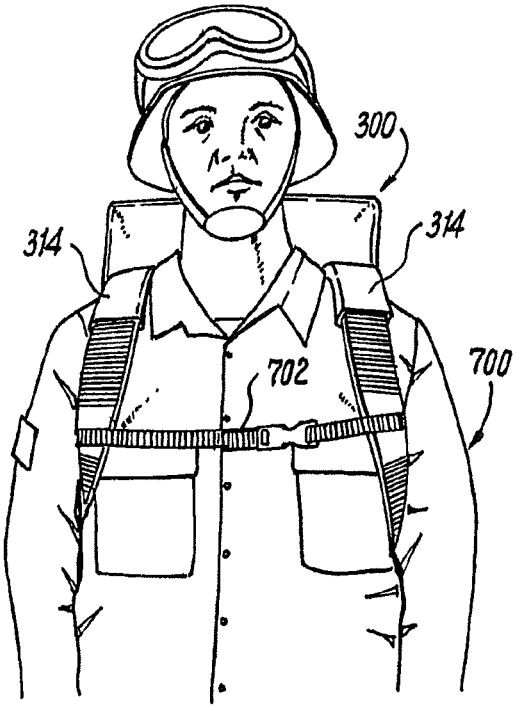
FIG. 7 depicts a front perspective view of the insulated bag in accordance with embodiments of the invention.

FIG. 7 depicts a front perspective view of the insulated bag 300 in accordance with embodiments of the invention. FIG. 7 depicts a user 700 wearing the insulated bag 300. While carrying the insulated bag 300, the user 700 can have a padded shoulder strap 314 over each shoulder (in various embodiments of the invention, the shoulder straps 314 are padded for further comfort). To further secure the insulated bag 300 to the user 700 (and to keep the shoulder straps 314 from sliding down the user's arm) an adjustable chest strap 702 connects (across the user's chest) one shoulder strap 314 to the other shoulder strap 314. For comfort, the user 700 can adjust the adjustable chest strap 702 and/or the shoulder straps 314.

Figure 8:
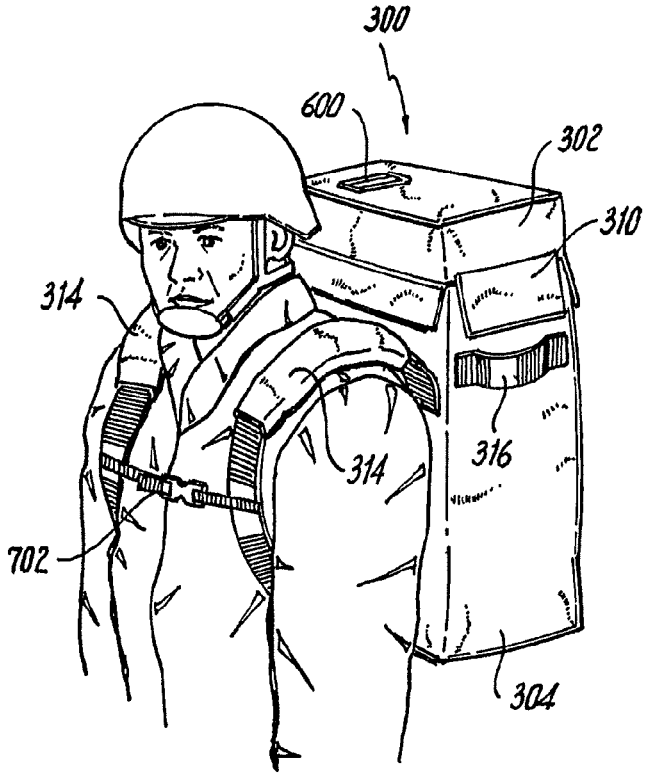
FIG. 8 depicts a side perspective view of the insulated bag in accordance with embodiments of the invention.

FIG. 8 depicts a side perspective view of the insulated bag 300 in accordance with embodiments of the invention. FIG. 8 is provided to depict the size and position of the insulated bag 300 relative to the user 700. To minimize stress on a user's lower back, the insulated bag 300 is positioned on the user's upper back.

Figure 9:
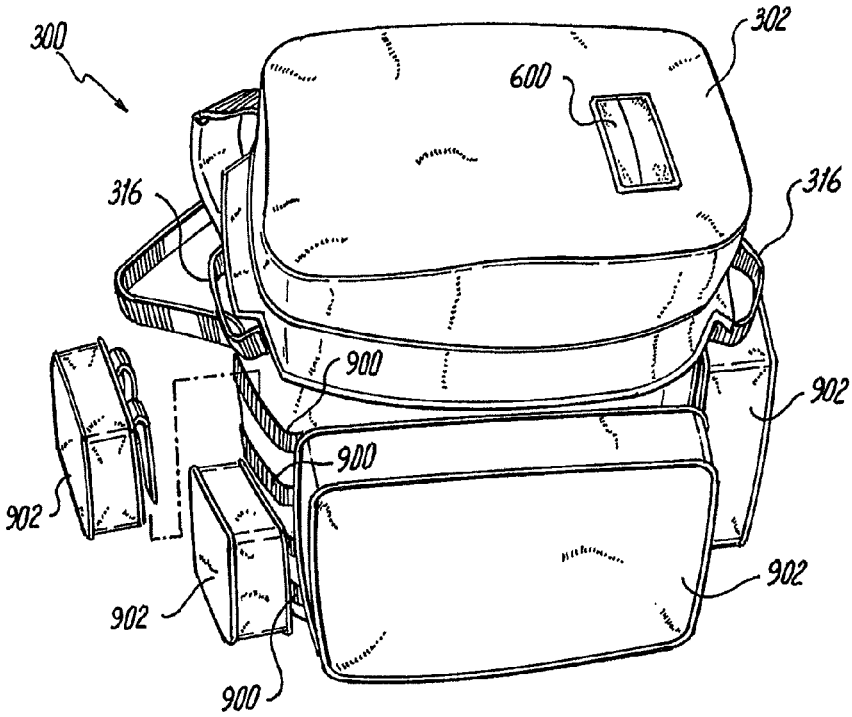
FIG. 9 depicts a perspective view of another embodiment of the insulated bag in accordance with embodiments of the invention.

FIG. 9 depicts a perspective view of another embodiment of the insulated bag 300 in accordance with embodiments of the invention. In various embodiments, other devices can be attached to the insulated bag 300. For example, in various embodiments, an interlock attaching strap system (also known as "Modular Lightweight Load-Carrying Equipment" ("MOLLE") system) is incorporated into the insulated bag 300. One such interlock attaching strap system is provided in U.S. Pat. No. 5,724,707 issued Mar. 10, 1998 and is incorporated by reference, in its entirety, herein.

MOLLE utilizes a Pouch Attachment Ladder System ("PALS") which includes webbing attached to the insulated bag 300 to secure a pouch(s) 902 to the insulated bag 300. The pouches 902 can be of various sizes.

In various embodiments, the interlock attaching system allows the fastening together of the insulated bag 300 with at least one pouch 902 by a semi-flexible vertical strap (on the pouch and not shown). The semi-flexible vertical strap is attached at one end of the pouch 902 and then interwoven between the horizontal strap 900 and a horizontal strap (not shown) on the pouch 902 in a manner which permits the insulated bag 300 and the pouch 902 to be attached together in a removable fashion.

At the one end of the vertical strap is a fastening element (not shown) which after passing through the straps 900 on the insulated bag 300 and then again through the horizontal straps on the pouch 902 is attached to the pouch 902 by a fastener (not shown) also secured to the pouch 902.

The straps 900 can be made of any suitable narrow fabric that are generally evenly spaced one from the other and attached across outer surfaces of the insulated bag 300. Spacing between the straps 900 should be of sufficient dimensions to permit the placement there-between of the horizontal straps on the pouch 902 to reside in channels formed between the straps 900.

Figure 10:
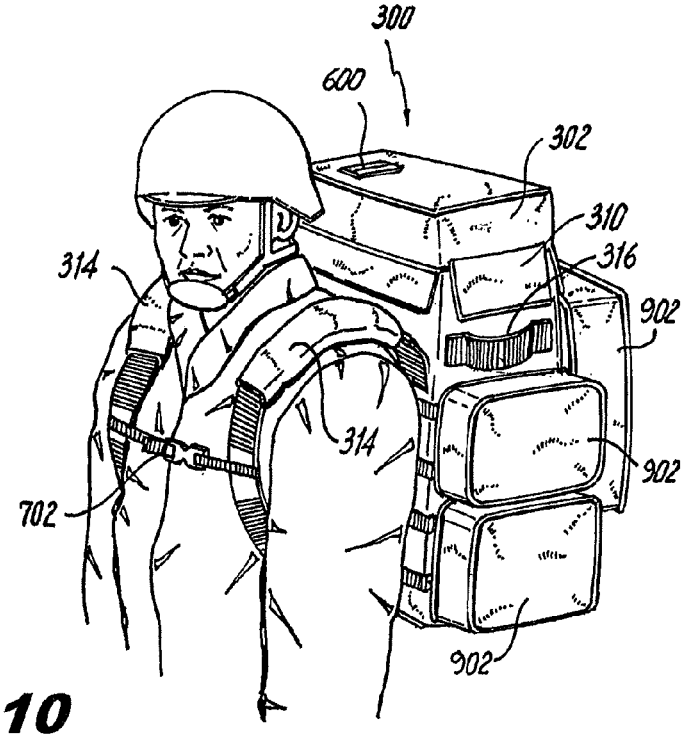
FIG. 10 depicts a side perspective view of an embodiment of the insulated bag in accordance with embodiments of the invention.

FIG. 10 depicts a side perspective view of an embodiment of the insulated bag 300 in accordance with embodiments of the invention. FIG. 10 is provided to depict a user 700 utilizing the insulated bag 300 which incorporates a interlocking strap attachment system.

Figure 11:
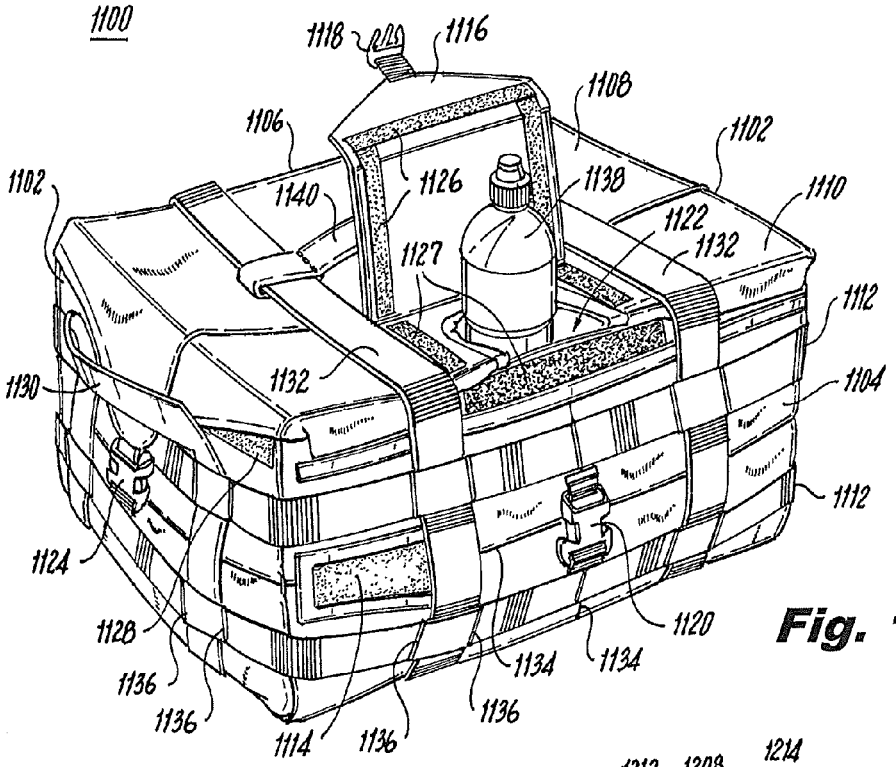
FIG. 11 depicts a perspective view of another embodiment of the invention.

FIG. 11 depicts a perspective view of an embodiment of a bag 1100 in accordance with aspects disclosed herein.

Specifically, bag 1100 includes two side-walls 1102 (only one of the side-walls is visible in FIG. 11), a front wall 1104, a rear wall 1106 (not visible in FIG. 11), a bottom wall (not visible in FIG. 11), a first bag flap portion 1108, and a second bag flap portion 1110.

Note that although the front wall (e.g., front wall 1104), the rear wall (e.g., rear wall 1106), and the bottom wall are described herein as being separate walls that description is only to make it easier to understand the geographical orientation of different components with respect to each other. It is to be understood that some components of the front wall 1104, the rear wall 1106, and the bottom wall are the same unitary piece of material. A more detail explanation is provided below regarding the description of FIG. 17.

Each of the walls (i.e., the side walls 1102, the front wall 1104, the rear wall 1106, the bottom wall, the first bag flap portion 1108, and the second bag flap portion 1110) is made of a durable material (e.g., CORDURA® fabric). Although the durable material is described herein as being made from CORDURA® that description is for illustrative purposes only and not intended in any way to limit the scope of the invention. Other durable materials can be used in accordance with embodiments of the invention. For example, various embodiments of the invention utilize materials having a linear density greater than (or less than) 500 denier and more durable than CORDURA® fabric.

The first bag flap portion 1108 and the second bag flap portion 1110 are attached to the bag front wall 1104 and the bag rear wall 1106, respectively.

The first bag flap portion 1108 includes a min-flap 1116. Illustratively, the mini-flap 1116 is depicted in an "open" position. When in the mini-flap 1116 is in the open position, a cavity 1122 is exposed. The cavity 1122 allows access to the contents of the bag 1100 without opening the first bag flap portion 1108 and the second bag flap portion 1110. Illustratively, FIG. 11 depicts a bottle protruding from the cavity 1122 to demonstrate that a user (not shown) can remove an item from the bag 1100 while the first bag flap portion 1108 and the second bag flap portion 1110 are in a "closed" position. The mini-flap 1116 includes a buckle portion 1118 (illustratively a male buckle portion) that interlocks with a corresponding buckle portion 1120 (illustratively a female buckle portion) located on the bag front wall 1104 when the mini-flap 1116 is in the a closed position.

On an interior side of the mini-flap 1116 (visible while the mini-flap 1116 is in the open position) are a plurality of hook/loop fasteners 1126. These hook/loop fasteners 1126 have corresponding hook/loop fasteners 1127 on the first bag flap portion 1108 that interlock when the mini-flap 1116 is in the closed position. The mini-flap 1116 can be placed in the closed position by placing hook/loop fasteners 1126 into contact with hook/loop fasteners 1127 with or without interlocking buckle portion 1118 with buckle portion 1120. However, interlocking buckle portion 1118 with buckle portion 1120 provides greater resistance to an unwanted opening of the mini-flap 1116 than just contacting hook/loop fasteners 1126 with hook/loop fasteners 1127.

Figure 12:
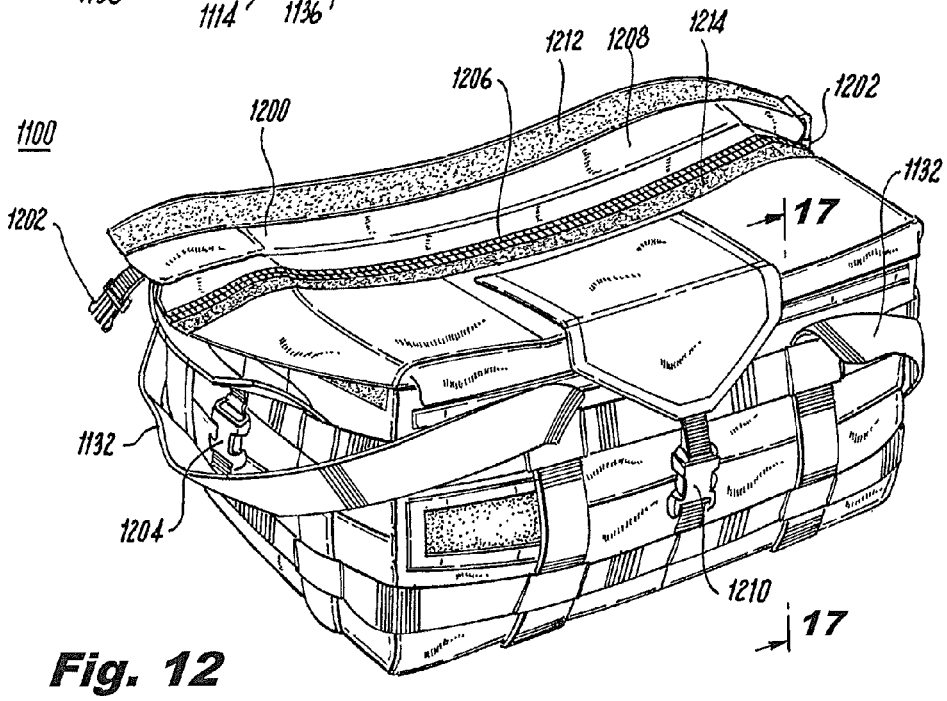
FIG. 12 depicts another perspective view of the embodiment of the invention depicted in FIG. 11.

The second bag flap portion 1110 includes male buckle portions 1202 coupled to female buckle portions 1204 (these coupled buckles are shown in FIG. 11 as side buckle 1124 and are depicted in FIG. 12 as uncoupled). Note that in FIG. 11 only one side buckle 1124 is visible.

The front wall 1104 includes a grommet 1114. The grommet 1114 allows a spigot (not shown) to protrude from the bag 1100 while the spigot is coupled to a bladder inside the bag 1100. The grommet 1114 is made of a flexible material (e.g., rubber, silicon, or CORDURA®) that allows movement of a portion of the grommet 1114 for insertion of the spigot while the rest of the grommet 1114 acts as a barrier between a bladder (not shown) and outside of the bag 1100.

Stitching 1136 attaches horizontal MOLLE webbing 1112 to the various layers (not shown) of the bag 1100. A more detailed explanation is provided below (and depicted in FIG. 17) indicating how the stitching 1136 secures the various layers of the bag 1100 together that are not visible in FIG. 11. The bag 1100 also includes pleats 1134 that also secure the durable material to other components to form the side-walls 1102, the front wall 1104, the rear wall 1106, and the bottom wall. A more detailed explanation is also provided below regarding the pleats 1134 and the layers of material that are secured together to form the side-walls 1102, the front wall 1104, the rear wall 1106, and the bottom wall.

In addition to serving as part of an interlock attaching system, the MOLLE webbing 1112 provides additional structural integrity to the bag 1100 (similar to horizontal bands on a barrel). Illustratively, FIG. 11 depicts two "bands" of horizontal webbing 1112 around the periphery of the bag 1100. However, the depiction of two bands is not intended to limit the scope of the invention in any way. It is appreciated that in various embodiments, the bag 1100 can include more or less than two bands of webbing 1112.

The stitching 1136 is stitched to the webbing 1112 in such a manner that spaces/tunnels are formed for the passage of side handle straps 1130 on the side-walls 1102 and vertical straps 1132 on the front wall 1104 and rear wall 1106. Note that in FIG. 11, one side-wall 1102 and the rear wall 1106 are not visible.

Side-walls 1102 also include part of a hook/loop fastener 1128 for securing the first bag flap portion 1108 and second bag flap portion 1110 to the side walls 1102. Although not shown in FIG. 11, the interior of the first bag flap portion 1108 and the second bag flap portion 1110 include hook/loop fasteners that correspond with hook/loop fastener 1128.

The bag 1100 can be placed in the closed position by placing hook/loop portions 1128 into contact with corresponding hook/loop portions (not shown) located on the underside of the first bag flap portion 1108 and the second bag flap portion 1110 with or without interlocking the buckle 1124. However, interlocking the buckle 1124 provides greater resistance to an unwanted opening of the bag 1100 than just contacting hook/loop portions 1128 with the corresponding hook/loop portions on the underside of the first bag flap portion 1108 and the second bag flap portion 1110.

FIG. 11 illustratively depicts two vertical straps 1132 however; it is appreciated that in various embodiments of the invention, bag 1100 can include a different number of vertical straps 1132. The vertical straps 1132 pass through the bottom (not shown) of the bag 1100. Although not visible in FIG. 11, the vertical straps 1132 include an adjustable buckle (hereinafter referred to as a "strap adjuster buckle")) for adjusting the tension that the vertical straps 1132 place on the bag 1100. The strap adjuster buckle allows insertion of an optional handle 1140 and use of the vertical straps 1132 as part of a tie-down mechanism of the bag 1100 to a stationary structure (e.g., a fixed location on a vehicle).

Although not shown in FIG. 11, each of the vertical straps 1132 is sewn to the bag 1100 (and the various layers of material of the bag 1100) in at least one location. Sewing the vertical straps 1132 to the bag 1100 secures the vertical straps 1132 to the bag 1100 at a strategic location(s). However, sewing the vertical straps 1132 to the bag 1100 does not prevent loosening of the vertical straps 1132 when desired.

FIG. 12 depicts another perspective view of the embodiment of the invention depicted in FIG. 11. Specifically, FIG. 12 depicts the bag 1100 in a partially closed position (i.e., the mini-flap 1116 is in the closed position). Hook/loop fasteners 1126 are in contact with hook/loop fasteners 1127 and male buckle portion 1118 is coupled to female buckle portion 1120 to form buckle 1210.

In FIG. 12, slack is placed on the vertical straps 1132 so that the vertical straps 1132 can be repositioned off of the first bag flap portion 1108 and the second bag flap portion 1110; and the bag 1100 can be partially/fully opened. The male buckle portions 1202 are decoupled from female buckle portions 1204 (when coupled these portions formed side buckle 1124 in FIG. 11).

A flap 1208 on the first bag flap portion 1108 is in an open position (i.e., pulled back exposing a zipper 1206 that joins the first bag flap portion 1108 to the second bag flap portion 1110). An underside of the bag flap 1208 (visible when the bag flap 1208 is pulled back) includes a hook/loop fastener 1212. The second bag flap portion 1110 includes a hook/loop fastener 1214 that mates with the hook/loop fastener 1212 when the flap 1208 is in a closed position.

FIG. 13 depicts yet another perspective view of the embodiment depicted in FIG. 11. In FIG. 13, the zipper 1206 is unzipped. The first bag flap portion 1108 and the second bag flap portion 1110 are pulled back so that the bag 1100 is in a fully open position. On the interior surfaces of the first bag flap portion 1108 and the second bag flap portion 1110 are hook/loop fasteners 1308. The hook/loop fasteners 1308 mate with hook/loop fasteners 1128 when the bag 1100 is in the closed position.

On the inside of the bag 1100 is a liner 1300. The liner 1300 is secured to the bag 1100 by snaps 1304. The liner 1300 is optional and in various embodiments is made of a water-resistant (and/or water-proof) material. For illustrative purposes, FIG. 13 includes an optional bladder 1302 and spigot 1306. The spigot 1306 is inserted through the grommet 1114 and into the bladder 1302. The spigot 1306 allows a user (not shown) to fill a secondary reservoir (e.g., a cup or canteen) from the bladder 1302 while the bag is completely sealed and mounted to a rigid structure.

FIG. 14 depicts a bottom corner portion of the embodiment depicted in FIG. 13. Specifically, FIG. 1400 depicts a bottom portion of the bag 1100 having a bottom material 1400 (e.g., a rubberized material, a silicon, or CORDURA®) to protect the bottom of the bag 1100. The vertical straps 1132 are shown in phantom because the vertical straps 1132 pass through the bottom of the bag 1100 under the bottom material 1400.

FIG. 15 depicts still another perspective view of the embodiment depicted in FIG. 11. Specifically, FIG. 15 depicts the bag 1100 tied down to a fixed structure 1500. The fixed structure 1500 can be secured to a movable object (e.g., a vehicle or plane). The fixed structure 1500 includes slots 1502.

In FIG. 15, the bag rear wall 1106 is visible. Also visible are buckles 1504 that are used to loosen/tighten the vertical straps 1132 by adjusting the tension that the vertical straps 1132 place upon the bag 1100. The vertical straps 1132 can be loosened and one end of each of the vertical straps 1132 placed through the slots 1502. Thereafter, the ends of the vertical straps 1132 are brought back together (e.g., via the buckle 1504, carabineers, or other locking mechanism) and tightened to secure the bag 1100 to the fixed structure 1500. In addition, a durable rope (e.g., paracord a.k.a. parachute chord a.k.a. 550 chord) uses the horizontal webbing to help hold the bag 1100 to the fixed structure 1500.

Figure 16:
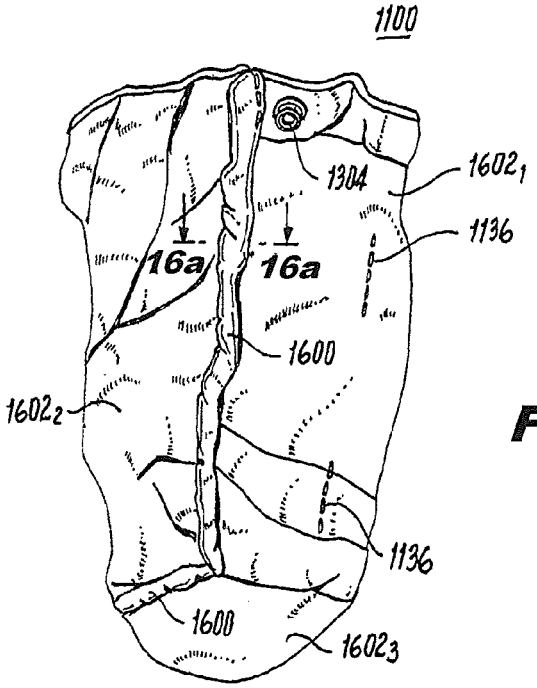
FIG. 16 depicts a interior perspective view of the embodiment depicted in FIG. 11.

FIG. 16 depicts a close-up interior perspective view of a corner of the embodiment of the bag 1100 depicted in FIG. 13. Specifically, FIG. 16 depicts two adjacent interior walls $\mathbf{1602}_1$ (for front wall 1104 (not shown)) and $\mathbf{1602}_2$ (for one of the side walls 1102 (not shown)); and an interior wall $\mathbf{1602}_3$ associated with the bottom wall (not shown). The interior walls $\mathbf{1602}_1$, $\mathbf{1602}_2$, and $\mathbf{1602}_3$ are made of a durable material (e.g., CORDURA®). Seam tape 1600 (e.g., a webbing material) is placed where interior walls $\mathbf{1602}_1$, $\mathbf{1602}_2$, and $\mathbf{1602}_3$ meet to increase their resistance to unwanted ripping. Although stitching of the interior walls $\mathbf{1602}_1$, $\mathbf{1602}_2$, and $\mathbf{1602}_3$ without the seam tape 1600 is durable, the addition the seam tape 1600 increases the tear resistance of the seams.

FIG. 16 also depicts stitching 1136 to show that the stitching 1136 goes through all of the layers of material.

Figure 16A:
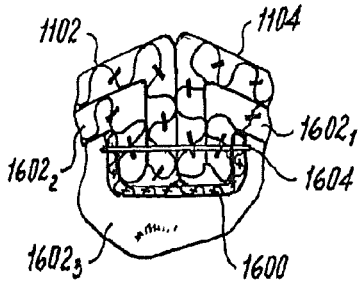
FIG. 16*a* depicts a top view of the corner depicted in FIG. 13.

FIG. 16*a* depicts a top view of the corner depicted in FIG. 13. FIG. 16*a* shows that it is not just interior walls $\mathbf{1602}_1$, $\mathbf{1602}_2$, $\mathbf{1602}_3$, and seam tape 1600 that are stitched together. Specifically, the seam tape 1600, the front wall 1104, and interior wall $\mathbf{1602}_1$ are part of an insulated front wall and are sewn together with interior wall $\mathbf{1602}_2$ and one of the side walls 1102. Although not shown in FIG. 16*a*, seam tape 1600 is stitched to the side edges of the unitary pieces of material (that form the front wall, the back wall, and the bottom wall) to the edges of material that form the side walls (except for the top edges of the side walls).

Figure 17:
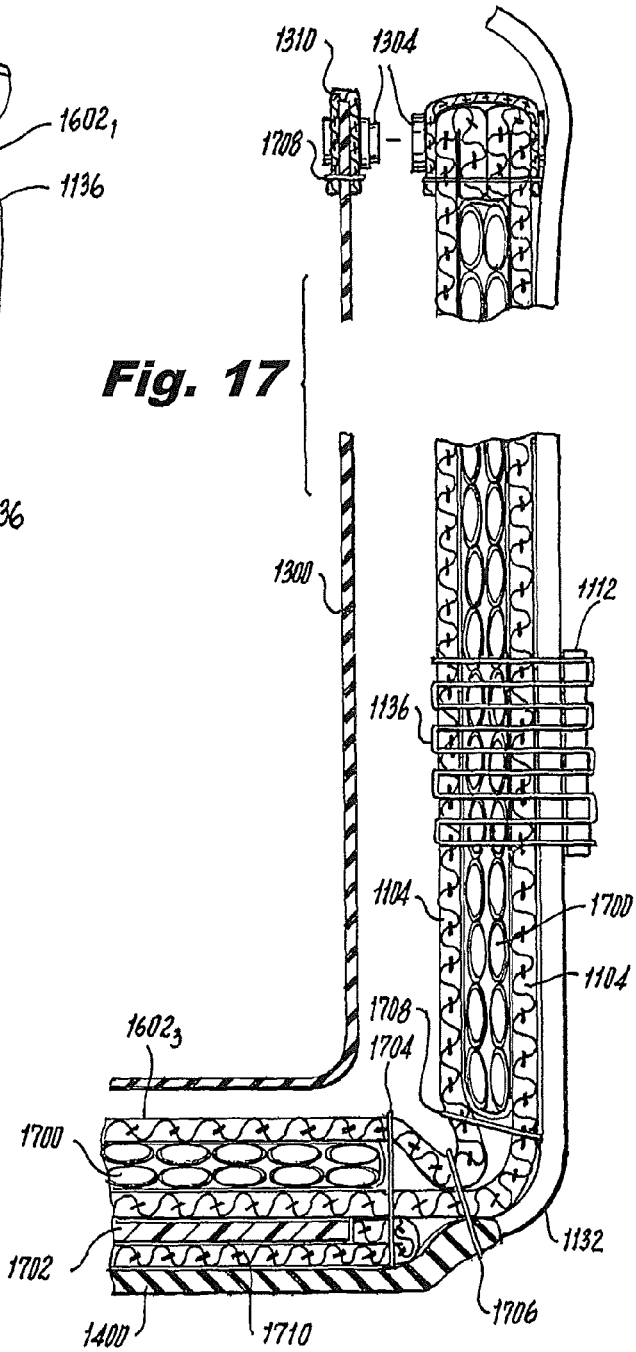
FIG. 17 depicts a cross-sectional view of the embodiment depicted in FIG. 11.

FIG. 17 depicts a cross-sectional view of the embodiment depicted in FIG. 11. Specifically, FIG. 17 depicts internal material layers not visible through the durable material (e.g., CORDURA®). Specifically, FIG. 17 depicts a cross-sectional view of the front wall and bottom wall of bag 1100. The cross-sectional view is taken where stitching 1136 stops just prior to the insertion of the vertical strap 1132 into slots formed between the horizontal webbing 1112, an outside layer of durable material 2004, and the stitching 1136. The stitching 1136 does not pass through vertical straps 1132.

The outside layer of durable material 1104 is a unitary piece that forms the outside layer of the front wall, the bottom wall, and the rear wall of the bag 1100. At the bottom of the bag 1100 (and under the outside layer of durable material 1104 is a base support 1702. In various embodiments of the invention, the size of the bag 1100 varies and depending upon the size of the bag 1100 a base support 1702 is not needed.

On the inside of the bag 1100 is another unitary layer of durable material 1104. An insulation material 1700 (e.g., double bubble insulation) is placed between the two layers of durable material 1104.

Under the base support 1702, is a bottom layer of durable material 1710. The bottom layer of durable material 1710 is folded along its edge. Stitches 1704 bind the two unitary layers of durable material 1104, and the folded edges of the bottom layer of durable material 1710. Stitches 1708 bind the two unitary layers of durable material 1104.

Under the bottom layer of durable material 1710 is a base layer 1400. The base layer 1400 can be made of various materials (e.g., a rubberized material, a silicon, or CORDURA®). The base layer 1400 is stitched along the corners to the two layers of durable material 1104. However, the stitching of the base layer 1400 to the two layers of durable material 1104 stops in certain areas so that the vertical strap 1132 can pass through the bottom of the bag 1100 between the base layer 1400 and the bottom layer of durable material 1710.

The vertical strap 1132 extends across the bottom of the bag 1100 and up to the other side (in this instance—the back wall of the bag 1100). The extension of the vertical strap 1132 across the bottom of the bag 1100 is shown in FIG. 14.

Stitching 1704, 1706, and 1708 help to define (and separate) the interior of the front wall, bottom wall, and rear wall. The stitching 1704, 1706, and 1708 also provides and compartmentalizes insulation 1700 placed between the unitary layers of material 1104.

On the top edge of the bag 1100, each of the durable layers of material 1104 is folded to form four layers of durable material. These four layers of durable material are stitched together and seal the insulation 1700 into the formed compartments. In various embodiments of the invention, a layer of webbing 1310 (e.g., seam tape) is stitched over the four layers of durable material.

Snap portions 1304 are placed through the stitched four layers of durable materials. An optional liner 1300 can be used with the bag 1700. The liner 1300 includes webbing 1310 (e.g., seam tape) sewn, via stitching 1708, along its top edge and corresponding snap portions 1304.

FIG. 18 depicts another embodiment of the invention. Specifically, FIG. 18 depicts a relatively small bag 1800. Specifically, bag 1800 includes two side-walls 1822 (only one of the side-wall is visible in FIG. 18), a front wall 1824, a rear wall 1826 (not visible in FIG. 18), a bottom wall (not visible in FIG. 18), a top wall 1802, and a mini-flap 1806.

Note that although the front wall (e.g., front wall 1824), the rear wall (e.g., rear wall 1826), and the bottom wall are described herein as being separate walls that description is only to make it easier to understand the geographical orientation of different components with respect to each other. It is to be understood that some components of the front wall 1824, the rear wall 1826, and the bottom wall are the same unitary piece of material. A more detail explanation is provided regarding the descriptions of FIGS. 17 and 20.

Each of the walls (i.e., the side walls 1822, the front wall 1824, the rear wall 1826, the bottom wall, the top wall 1802, and the mini-flap 1806) is made of a durable material (e.g., CORDURA® fabric). Although the durable material is described herein as being made from CORDURA® that description is for illustrative purposes only and not intended in any way to limit the scope of the invention. Other durable materials can be used in accordance with embodiments of the invention. For example, various embodiments of the invention utilize materials having a linear density greater than (or less than) 500 denier and more durable than CORDURA® fabric.

The min-flap 1806 is part of the top wall 1802. Illustratively, the mini-flap 1806 is depicted in an "open" position. When the mini-flap 1806 is in the open position, a cavity 1812 is exposed. The cavity 1812 allows access to the contents of the bag 1800 with minimal exposure to other contents in the bag 1800. Illustratively, FIG. 18 depicts a bottle 1828 protruding from the cavity 1812 to demonstrate that a user (not shown) can remove a single bottle 1828 from the bag 1800 while leaving bottles that may still be in the bag 1800 unexposed. The mini-flap 1806 includes a buckle portion 1814 (illustratively a male buckle portion) that interlocks with a corresponding buckle portion 1816 (illustratively a female buckle portion) located on the bag front wall 1824 when the mini-flap 1116 is in a "closed" position.

On an interior side of the mini-flap 1806 (visible while the mini-flap 1806 is in the open position) are a plurality of hook/loop portions 1808. These hook/loop portions 1808 have corresponding hook/loop portions 1809 on the top wall 1802 and the front wall 1824 when the mini-flap 1806 is in the closed position. The mini-flap 1806 can be placed in the closed position by placing hook/loop portions 1808 into contact with hook/loop portions 1809 with or without interlocking buckle portion 1814 with buckle portion 1816. However, interlocking buckle portion 1814 with buckle portion 1816 provides greater resistance to an unwanted placement of the mini-flap 1806 in the opened position than just contacting hook/loop portions 1808 with hook/loop portions 1809.

Stitching 1830 attaches horizontal webbing 1804 to the outer periphery of the bag 1800 (i.e., to side-walls 1822, the front wall 1824, the rear wall 1826 (not shown in FIG. 18)).

The bag 1800 also includes pleats 1832 that also secure the durable material to other components to form the side-walls 1822, the front wall 1824, the rear wall 1826, the top wall 1802, and the bottom wall.

In various embodiments, the layers of materials (and how they are secured together) that form the bag 1800 can be constructed as described above with respect to FIG. 17. In other embodiments, the layers of materials (and how they are secured together) that form the bag 1800 can be constructed as described below with respect to FIG. 20.

Vertical straps 1818 are positioned between the horizontal webbing 1804 and the outer surfaces of the front wall 1824 and the rear wall 1826. The vertical straps 1818 extends from the front wall 1824, past the bottom wall, up the rear wall 1826, and forms a handle 1820 at the top wall 1802. Although not shown in FIG. 18, each of the vertical straps 1818 is sewn to the bag 1800 (and the various layers of material of the bag 1800) in at least one location. Sewing the vertical straps 1818 to the bag 1800 secures the vertical straps 1818 to the bag 1800 at a strategic location(s).

The horizontal webbing 1804 and the vertical webbing 1818 provide additional structural integrity to the bag 1800. Illustratively, FIG. 18 depicts two bands of horizontal webbing 1804 around the periphery of the bag 1800. However, the depiction of two bands is not intended to limit the scope of the invention in any way. It is appreciated that in various embodiments, the bag 1800 can include more or less than two bands of horizontal webbing 1804.

In FIG. 18, the bag 1800 includes optional rings 1810 for securing a shoulder strap (not shown) to the bag 1800. The vertical straps 1818 and/or the horizontal straps 1804 can be used (with paracord (or other rope) and or straps) to tie down the bag 1800 to a stationary structure (e.g., a fixed point on a vehicle).

FIG. 19 depicts yet another embodiment of the invention. Specifically, bag 1900 includes two side-walls 1922 (only one of the side-wall is visible in FIG. 19), a front wall 1914, a rear wall 1920 (not visible in FIG. 19), a bottom wall (not visible in FIG. 19), a first bag flap portion 1902, and a second bag flap portion 1903. Each of the walls (i.e., the side walls 1922, the front wall 1914, the rear wall 1920, the bottom wall, the first bag flap portion 1902, and the second bag flap portion 1903) is made of a durable material (e.g., CORDURA® fabric).

Although the durable material is described herein as being made from CORDURA® that description is for illustrative purposes only and not intended in any way to limit the scope of the invention. Other durable materials can be used in accordance with embodiments of the invention. For example, various embodiments of the invention utilize materials having a linear density greater than (or less than) 500 denier and more durable than CORDURA® fabric.

One of the ways in which bag 1900 differs from bag 1100 is that bag 1900 does not include the pleating contained in bag 1100. As such, there is no stitching of the durable layers of material through the insulation in bag 1900.

Note that although the front wall (e.g., front wall 1914), the rear wall (e.g., rear wall 1920), and the bottom wall are described herein as being separate walls that description is only to make it easier to understand the geographical orientation of different components with respect to each other. It is to be understood that some components of the front wall 1914, the rear wall 1920, and the bottom wall are the same unitary piece of material. A more detail explanation is provided regarding the description of FIG. 20.

In FIG. 19, only one layer of webbing 2004 is visible. However, the bag 1900 includes two layers of webbing 2004 that sandwich the durable material (i.e., on the two side-walls 1902, the front wall 1914, and the rear wall 1920). Greater detail regarding the sandwiching of the two layers of webbing is provided below.

The first bag flap portion 1902 and the second bag flap portion 1903 are attached to the bag front wall 1914 and the bag rear wall 1920, respectively.

The first bag flap portion 1902 includes a min-flap 1910. Illustratively, the mini-flap 1910 is depicted in a "closed" position. The mini-flap 1910 is secured in the closed position by hook/loop fasteners (not shown) and front buckle 1916. However, when the mini-flap 1910 is in the open position, a cavity (not shown) is exposed. The cavity allows access to the contents of the bag 1900 without opening the first bag flap portion 1902 and/or the second bag flap portion 1903. The operation of the mini-flap 1910 operates similarly the mini-flap 1116 and mini-flap 1806 described above and depicted in FIGS. 11 and 18, respectively.

The bag 1900 includes an optional handle 1908. Note that in various embodiments of the invention, bag 1900 includes other optional features such as side handles (described above as handles 1130 and depicted FIG. 11) and a grommet (also described above as grommet 1114 and depicted in FIG. 11).

Stitching 1912 attaches horizontal MOLLE webbing 1904 to the outer periphery of the bag 1900 and to horizontal MOLLE webbing (not shown) on the opposite side of the bag 1900. A more detailed explanation is provided below indicating how the stitching 1912 secures other components together that are not visible in FIG. 19.

In addition to serving as part of an interlock attaching system, the MOLLE webbing 1904 provides additional structural integrity to the bag 1900 (similar to horizontal bands on a barrel). The Illustratively, FIG. 19 depicts two "bands" of horizontal webbing 1904 around the periphery of the bag 1900. However, the depiction of two bands is not intended to limit the scope of the invention in any way. It is appreciated that in various embodiments, the bag 1900 can include more or less than two bands of webbing 1904.

The stitching 1912 secures the webbing 1904 to the bag 1900 in such a manner that spaces/tunnels are formed for the passage of optional side handle straps (not shown) on the side-walls 1922 and vertical straps 1906 on the front wall 1914 and rear wall 1920. Note that in FIG. 19, one side-wall 1922 and rear wall 1920 are not visible.

Side-walls 1922 also include part of a hook/loop fastener 1924 for securing the first bag flap portion 1902 and second bag flap portion 1903 to the side walls 1922. The bag 1900 can be placed in the closed position by placing hook/loop fasteners 1128 into contact with corresponding hook/loop fasteners (not shown) located on the underside of the first bag flap portion 1902 and the second bag flap portion 1903 with or without interlocking the side buckle 1918. However, interlocking the buckle 1918 provides greater resistance to an unwanted opening of the bag 1900 than just contacting hook/loop portions 1924 with the corresponding hook/loop portions on the underside of the first bag flap portion 1902 and the second bag flap portion 1903.

FIG. 19 illustratively depicts two vertical straps 1906 however; it is appreciated that in various embodiments of the invention, bag 1900 can include a different number of vertical straps 1906. The vertical straps 1906 pass through the bottom (not shown) of the bag 1900 similarly to that depicted in FIG. 14. Although not visible in FIG. 19, the vertical straps 1906 include a buckle (hereinafter referred to as a "strap adjuster buckle") for adjusting the tension that the vertical straps 1906 place on the bag 1900. The strap adjuster buckle allows insertion of an optional handle 1908 and use of the vertical straps 1906 as part of a tie-down mechanism of the bag 1900 to a stationary structure (e.g., a fixed location on a vehicle).

Figure 20:
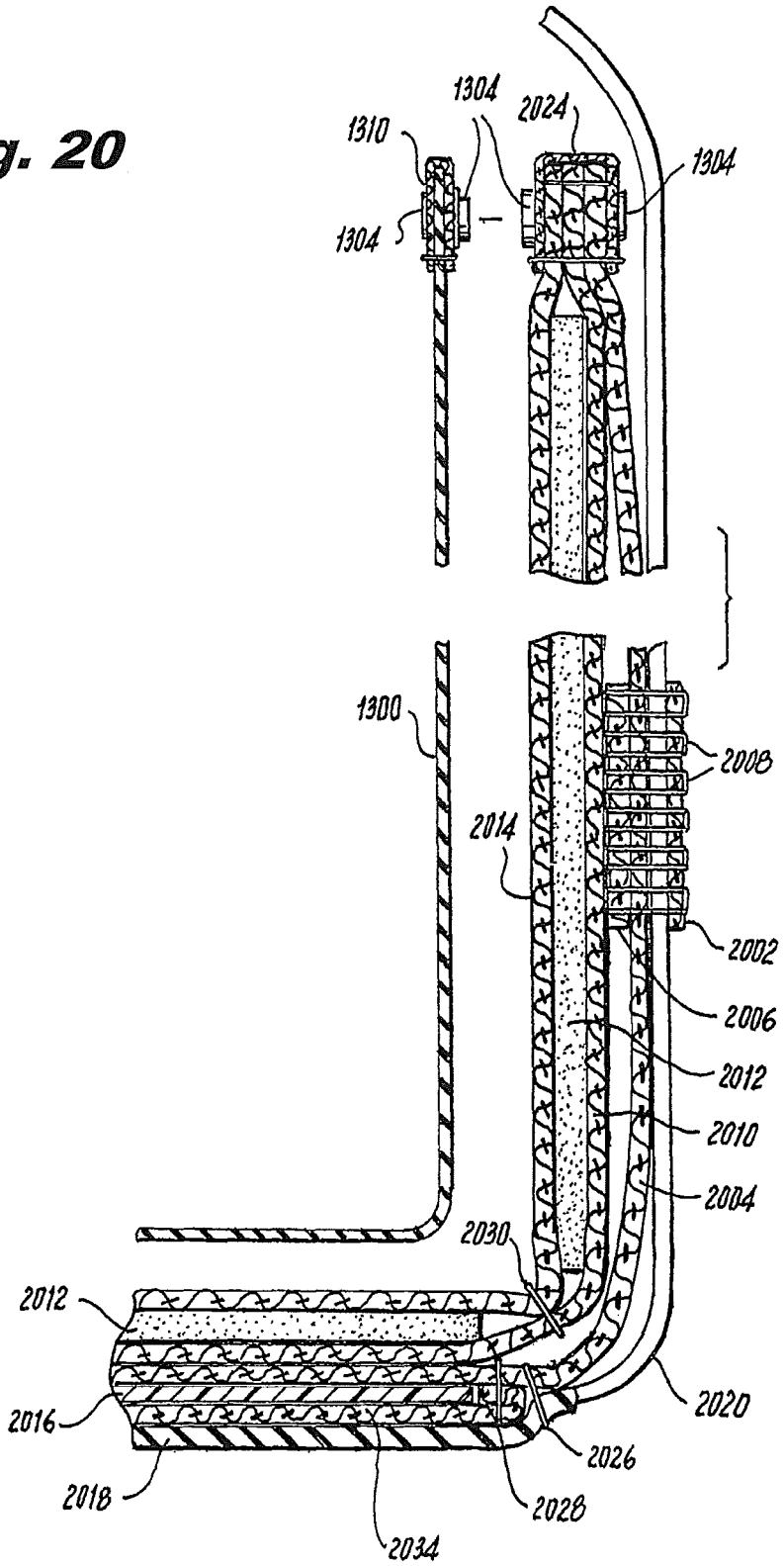
FIG. 20 depicts a cross-sectional view of the embodiment depicted in FIG. 19.

FIG. 20 depicts a cross-sectional view of the embodiment depicted in FIG. 19. Specifically, FIG. 20 depicts a cross-sectional view of the front wall and bottom wall of bag 1900. The cross-sectional view is taken where stitching 2008 stops just prior to the insertion of the vertical strap 2020 into slots formed between the outside webbing 2002, an outside layer of durable material 2004, and the stitching 2008.

On the front wall (and back wall (not shown)) an outside layer of durable material 2004 is sandwiched between outside webbing 2002 and inside webbing 2006. Stitching 2008 secures the durable material 2004, outside webbing 2002, and inside webbing 2006 together. Stitching 2008 does not pass through vertical strap 2020 or unitary layer of durable material 2010.

The outside layer of durable material 2004 is a unitary piece that forms the outside layer of the front wall, the bottom wall, and the rear wall of the bag 1900. At the bottom of the bag 1900 (and under the outside layer of durable material 2004) is a base support 2016. In various embodiments of the invention, the size of the bag 1900 varies and depending upon the size of the bag 1900 a base support 2016 is not needed.

Under the base support 2016, is a bottom layer of durable material 2034. The bottom layer of durable material 2034 is folded along its edge. The folded edge is stitched 2028 to the outside layer of durable material 2004.

Under the bottom layer of durable material 2034, is an optional durable bottom 2018. Depending upon the size of the bag 1900, the durable bottom 2018 is not needed. The durable bottom 2018 is stitched 2026 to the outside layer of durable material 2004. However, the stitching 2026 of the durable bottom 2018 to the outside layer of durable material stops in certain areas so that the vertical strap 2020 can pass through the bottom of the bag 1900 between the durable bottom 2018 and the bottom layer of durable material 2034.

The vertical strap 2020 extends across the bottom of the bag 1900 and up to the other side (in this instance—the back wall of the bag 1900). The extension of the vertical strap 2020 across the bottom of the bag 1900 is shown in FIG. 14.

Inside the bag 1900 are two unitary layers of durable material (2010 and 2014, respectively). Stitching 2030, along the bottom corners of the bag 1900, help to define (and separate) the interior of the front wall, bottom wall, and rear wall. The stitching 2030 also provides and compartmentalizes insulation 2012 (e.g., various insulation made by Aerogel®) placed between the unitary layers of material 2010 and 2014.

On the top edge of the bag 1900, the outside durable material 2004, the inside layer of durable material 2010, and the inner most layer of durable material 2014 are stitched together. In various embodiments of the invention, a layer of webbing 2024 (e.g., seam tape) is stitched with durable materials 2004, 2010, and 2014.

Snap portions 1304 are placed through the stitched layers of durable materials 2004, 2010, 2014, and 2024. An optional liner 1300 can be used with the bag 1900. The liner 1300 includes webbing 1310 (e.g., seam tape) sewn along its top edge and corresponding snap portions 1304.

It is appreciated that the layering and securing of materials as described herein (in FIGS. 17 and 20) can be used to construct other embodiments of the invention described above with respect to FIGS. **3-6*b* and 9. It is also appreciated that various embodiments of the invention depicted in FIGS. 3-6*b* and 9** utilize the layering and securing of materials described herein without utilizing vertical straps.

Although the bags have been described herein as bags that hold water. Those descriptions are for illustrative purposes only. It is appreciated that that the bags disclosed herein can hold other items (e.g., meals-ready-to-eat ("MREs")).

In addition, buckles have been used herein to describe a locking mechanism. However, the use of the term buckles is not intended to limit the scope of the invention in any way. It is appreciated that other locking mechanisms can be used in accordance with the invention.

While the foregoing is directed to embodiments of the present invention, other and further embodiments of the invention may be devised without departing from the basic scope thereof, and the scope thereof is determined by the claims that follow.

We claim:

1. A bag comprising:

a unitary first layer of durable material, wherein said unitary first layer of durable material is shaped to form part of a front wall, a bottom wall, a rear wall, first top edges, first side edges, an inner surface, and an outer surface;

a unitary second layer of durable material, wherein said unitary second layer is another part of said front wall, said bottom wall, and said rear wall, said unitary second layer includes second top edges and second side edges;

a first section of at least one layer of insulation between said unitary first layer and said unitary second layer of said front wall;

a second section of at least one layer of insulation between said unitary first layer and said unitary second layer of said bottom wall;

a third section of at least one layer of insulation between said unitary first layer and said unitary second layer of said rear wall;

two side walls in contact with said front wall, said bottom wall, and said rear wall, wherein each said side walls includes two layers of durable material, at least one layer of insulation disposed between each said two durable layers in the side walls, said side walls having edges in contact with said edges of said front wall, said bottom wall, and said rear wall;

a first strip of webbing stitched over said side wall edges and said edges of said front wall, said bottom wall and said rear wall;

at least one strip of horizontal webbing stitched to said front wall, said rear wall, and said side walls;

a plurality of vertical stitching through said horizontal webbing, said front wall, rear wall, and said side walls;

a plurality of pleats stitched through said front wall, said rear wall, and said side walls; and wherein said first top edges of said unitary first layer and said second top edges of said unitary second layer are folded;

a second strip of webbing stitched over said folded first top edge of said unitary first layer of said front wall and said folded second top edge of said unitary second layer of said front wall;

a third strip of webbing stitched over said folded first top edge of said unitary first layer of said rear wall and said folded second top edge of said unitary second layer of said rear wall;

a first bag flap stitched to said rear wall;

a mini flap stitched to said first bag flap;

a second bag flap stitched to said front wall;

a rigid material in contact with said bottom wall;

a unitary third layer of material in contact with said rigid material, said unitary third layer includes third top edges and third side edges;

wherein said third top edges of said unitary third layer are folded and stitched to said unitary first layer and said unitary second layer; and bottom stitching securing said unitary first layer to said unitary second layer, wherein said bottom stitching, said stitching of said second strip of webbing, said stitching of said third strip of webbing, and said stitching of said two side walls to said unitary first layer and said unitary second layer encloses, said first section of at least one layer of insulation between said unitary first layer and said unitary second layer of said front wall, and said second section of at least one layer of insulation between said unitary first layer and said unitary second layer of said rear wall.

2. The bag of claim 1, wherein said unitary first layer and said unitary second layer form a top wall stitched to said front wall; and vertical straps stitched to said top wall, said bottom wall, and said front wall.

3. The bag of claim 2, further comprising a grommet secured to said front wall.

4. The bag of claim 2, wherein said mini-flap includes a first buckle portion and said front wall includes a second buckle portion receptive to said first buckle portion.

5. The bag of claim 2, further comprising a durable bottom stitched to said unitary first layer and said unitary second layer, wherein said vertical straps are between said durable bottom and said unitary third layer.

6. The bag of claim 5, wherein said durable bottom is one of a rubberized material, a silicon based material and CORDURA®.

* * * * *